US008266822B2

(12) United States Patent
Fraza

(10) Patent No.: US 8,266,822 B2
(45) Date of Patent: Sep. 18, 2012

(54) DRYING PROCESS OF TRITURATED CRUSHED SUGAR-CANE OR OTHERS FOR LATTER BRIQUETTING OR OTHERS

(76) Inventor: Carlos Fraza, Sau Paulo (BR)

( * ) Notice: Subject to any disclaimer, the term of this patent is extended or adjusted under 35 U.S.C. 154(b) by 759 days.

(21) Appl. No.: 12/142,227

(22) Filed: Jun. 19, 2008

(65) Prior Publication Data

US 2008/0313917 A1 Dec. 25, 2008

(30) Foreign Application Priority Data

Jun. 19, 2007 (BR) ..... 0701974

(51) Int. Cl.
*F26B 11/12* (2006.01)

(52) U.S. Cl. ..... 34/443; 34/500

(58) Field of Classification Search ..... 34/443, 34/493, 500, 179, 181
See application file for complete search history.

(56) References Cited

U.S. PATENT DOCUMENTS 3,436,314 A * 4/1969 Leonor ..... 202/117
6,393,728 B1 * 5/2002 Sairanen et al. ..... 34/398
* cited by examiner

*Primary Examiner* — Jiping Lu
(74) *Attorney, Agent, or Firm* — Ostrolenk Faber LLP

(57) ABSTRACT

An improvement for drying crushed cane or other bagasse for briquetting or other processes includes a drying unit (1) with a humid bagasse dosing hopper (2) having a screw conveyor feeding inclined screw conveyor (5) and a latter rotary dosing valve (6) discharging into hot air funnel (7) into drying tank (8), bagasse being lifted and exposed to the hot air in front chamber (9) and in final drying chamber (17) by tumbling blades (10) through the action of geared motor (15), almost-dry bagasse in suspension being sucked out by pair of centrifugal blowers (18) dropping it into separator filter (19) and falling into hopper (20), being cooled in open-trough screw conveyors (21) and (22), screw conveyor (22) including screen (23) for separation of powder to be conveyed by screw conveyor (25) to inclined screw conveyor (26) for discharge into feeder hoppers (28) to the burners (32).

1 Claim, 8 Drawing Sheets

DRYING PROCESS OF TRITURATED CRUSHED SUGAR-CANE OR OTHERS FOR LATTER BRIQUETTING OR OTHERS

BACKGROUND

1. Field of the Disclosure

The present specification of patent of invention relates to an improvement introduced into the process of drying crushed cane or other bagasses for subsequent briquetting or other processes, the development whereof has led to the obtainment of a compact unit to carry out the process of drying appropriately crushed cane or other bagasses such that it may be used for briquetting or other processes.

2. Related Art

The discovery of fire as a source of energy and heat was the touch paper for the emergence of new civilizations. In addition such new civilizations generated a demand for new sources of energy to satisfy new requirements for comfort.

The growth in energy consumption led to the consumption of immense areas of forest generating the need to seek new sources of energy. There emerged electricity, and the solutions employed by this new source of energy, which, in turn, obliged the commencement of a search for new sources of energy.

From thermal to modern hydroelectric power stations, including the search for more efficient nuclear energy solutions, much research is being carried out and a great deal of money has been invested to satisfy the aforementioned demand.

Such new sources of energy include photovoltaic cell, thermosolar, hydrogen and biomass solutions.

Biomass utilizes residues of plants following harvesting or those cultivated specifically for this purpose with the objective of increasing the potential of this energy resource and preventing, during the decomposition thereof, occurrence of the generation of methane gas considered to be a damaging factor for the ozone layer. The combustion thereof generates carbon dioxide which, in spite of this disadvantage, causes less damage to the ozone layer.

The utilization of ethyl alcohol or ethanol from sugar cane as an energy resource for automobile vehicles which emerged as a result of the 1973 energy crisis became, principally in Brazil, one of the principal sources at the time of the replacement of energy of fossil origin by energy from renewable sources to prevent environmental collapse.

It arises that the juice used for the production of alcohol and sugar is solely one of the parts of cane, the bagasse and tops until that moment having been lost as a source of energy.

Some sugar and alcohol mills started burning said bagasse in furnaces to generate heat and electric energy both for their own consumption and to sell the excess electric energy. The serious problem with direct combustion of cane bagasse lies in the fact that it retains a certain level of humidity and when thrown into the furnace part of the heat of combustion is expended solely in drying the bagasse and only then is sufficient heat generated to suitably drive the steam turbine.

It is noted that such combustion for the purpose of drying bagasse involves, in addition to lower efficiency, loss of time.

Having the objective of improving combustion efficiency various solutions have been tried such as drying bagasse in rotary driers. Such driers are constituted by large cylindrical tubular metal tanks encircled by rings and supported on a bed, wherein the entire cylinder rotates around an imaginary axis through the action of an electric motor and gearing. Hot air is injected, passing through the interior of such cylindrical tank along an imaginary central axis, exiting at the opposite side.

These tanks possess beating plates such that on the rotation thereof bagasse is carried to the upper part of the tank and is "cast down" through the current of hot air crossing the tank.

However efficient the drying process may be it must be stressed that the weight of the tank is very high requiring great electrical energy consumption which may not equalize the work of drying.

SUMMARY

In addition the direct introduction of hot air having a rectilinear trajectory crossing the tank as well as not providing great drying efficiency, given that the hot air does not fill the entire tank, it may lead to combustion of bagasse and the consequent incineration thereof and total loss of the product being dried.

In the patent herein applied for the present improvement introduced into the process of drying crushed cane or other bagasses for subsequent briquetting or other processes is constituted by a continuous process for drying crushed cane bagasse or other similar product proceeding from the sugar and alcohol mill itself, with the objective of it containing a level of humidity suitable for subsequent briquetting or other processes, such process having low costs by virtue of the consumption of electric energy being significantly below that of the aforementioned solutions.

Furthermore the majority of other driers solely utilize combustion of butane gas or natural gas for generating the hot air utilized in the drying process, whereas the dryer subject of the patent herein applied for utilizes the combustion of cane bagasse powder proceeding from the drying process itself, separated during cooling phase thereof, as fuel together with a small quantity of butane gas or natural gas which, being combusted together with such cane bagasse powder, generates fierce heat, being insufflated into the fixed cylindrical tank.

Bagasse drying is realized within the said cylindrical tank into which cane bagasse, having a humidity of the order of 50 to 65%, is introduced through the action of a screw conveyor through a rotary valve and into the tank in the flow of a jet of hot air proceeding from two burners (commonly referred to as mixing chambers) at a temperature of the order of 500° C., centrifugal blowers blowing the dry cane bagasse powder obtained in the bagasse drying process itself being subsequently fed through small hoppers as aforesaid. The fierce heat generated is forced to pass through lower pipework running to the rear portion of the tank, rising through contiguous pipework and returning to the nozzle which solely injects hot air at a temperature of the order of 500° C. into the drying tank, inlet which is disposed below a rotary valve forcing the introduction of humid bagasse directly into the jet of hot air and preventing its return. A pair of hoppers is provided to permit feeding the burners (mixing chambers) for the purpose of initiating the firing thereof.

Drying within the tank is realized through the action of the aforementioned jet of hot air and the action of a plurality of assemblages of blades, equidistantly distributed and affixed, rotating around their longitudinal axis, said blades being to some degree disposed in the form of a spiral such as to force movement in a forward direction on tumbling. Preferentially between the first and the second assemblage of blades there are disposed plates partially closing off the passage of hot air, forming a front chamber and a rear chamber within the drying tank, maintaining the hottest air in the front chamber. The sudden thermal shock in the front chamber of such humid cane-bagasse drying tank causes combustion of the proteins (sugar).

The continuous lifting and tumbling of crushed bagasse and exposure thereof to said hot air assists in drying, and on becoming dry, and thus lighter, it tends to remain in suspension such that through the action of a pair of suitable blowers disposed in the upper rear portion of the tank it is sucked from within the said tank and carried along pipework to a separator filter of the cyclone type, separating the humid air from the bagasse, which falls under gravity into a hopper still at a temperature of the order of 40 to 50° C., and under gravity into a screw conveyor, the trough whereof being open, in the return sense, that is to say in the direction of the humid bagasse shredder hopper, the movement whereof having the objective of causing the partial cooling of the aforementioned dry bagasse such that, at the end of this trajectory, it is discharged into another screw conveyor, the trough whereof also being open, however moving in the inverse direction to the previous screw conveyor, with the objective of completing the process of cooling the aforementioned dry bagasse, the trough of this second screw conveyor having in its initial portion an extremity in the bottom thereof in the form of a screen to realize the separation of such dry powder from the dry cane bagasse, which powder falls into a trough being extracted and conveyed by a screw conveyor to a yet further inclined screw conveyor which drops said dry cane bagasse powder into a distributor trough which drops it into two hoppers; the powder from said hoppers is subsequently used as fuel for the aforementioned burners (mixing chambers) and dry bagasse from the screw conveyor falls into a further inclined screw conveyor being dropped into a buffer tank feeding in a continuous manner a briquetting machine which thereupon feeds a silo to feed a rotary table to fill large sacks or, on removing the silo and rotary table assembly, permitting the direct continuous filling of a tipper truck body.

BRIEF DESCRIPTION OF THE DRAWINGS

For the better comprehension of the subject of the present patent references shall be made to the appended drawings wherein.

DETAILED DESCRIPTION OF THE EMBODIMENTS

Figure 1:
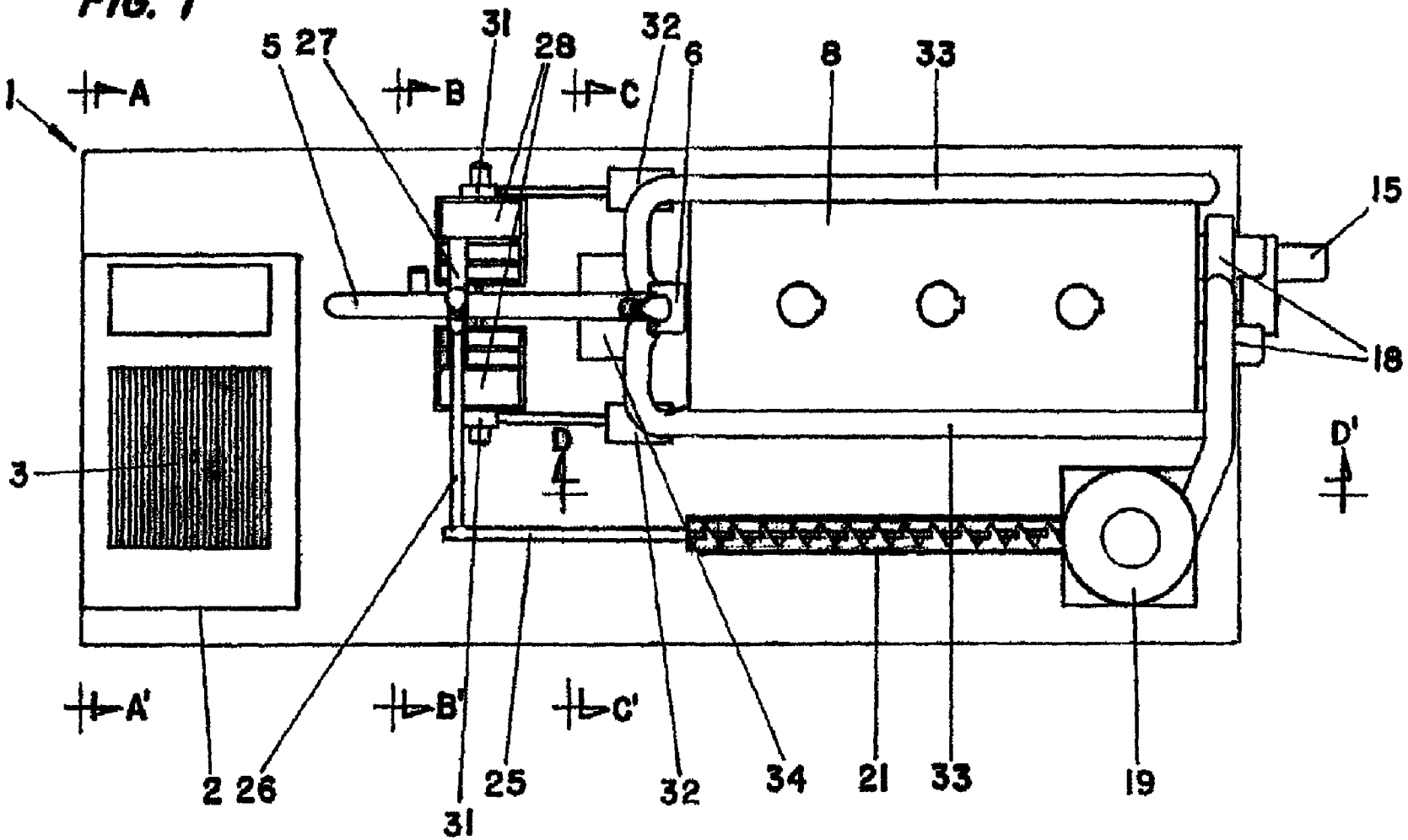
FIG. 1 shows a plan view of the compact drying unit, there being observed the hopper for receiving humid bagasse, the screw conveyor feeding the rotary valve, the drying tank, the dry powder hoppers, the burners (mixing chambers), the fierce heat-muffling hot air pipework, the dry bagasse suction blowers, the cyclone-type separator filter, the screw conveyor with open trough and the screw conveyor discharging dry powder into an inclined screw conveyor for dropping into a distributor trough for the hoppers feeding the burners (mixing chambers)
Figure 2:
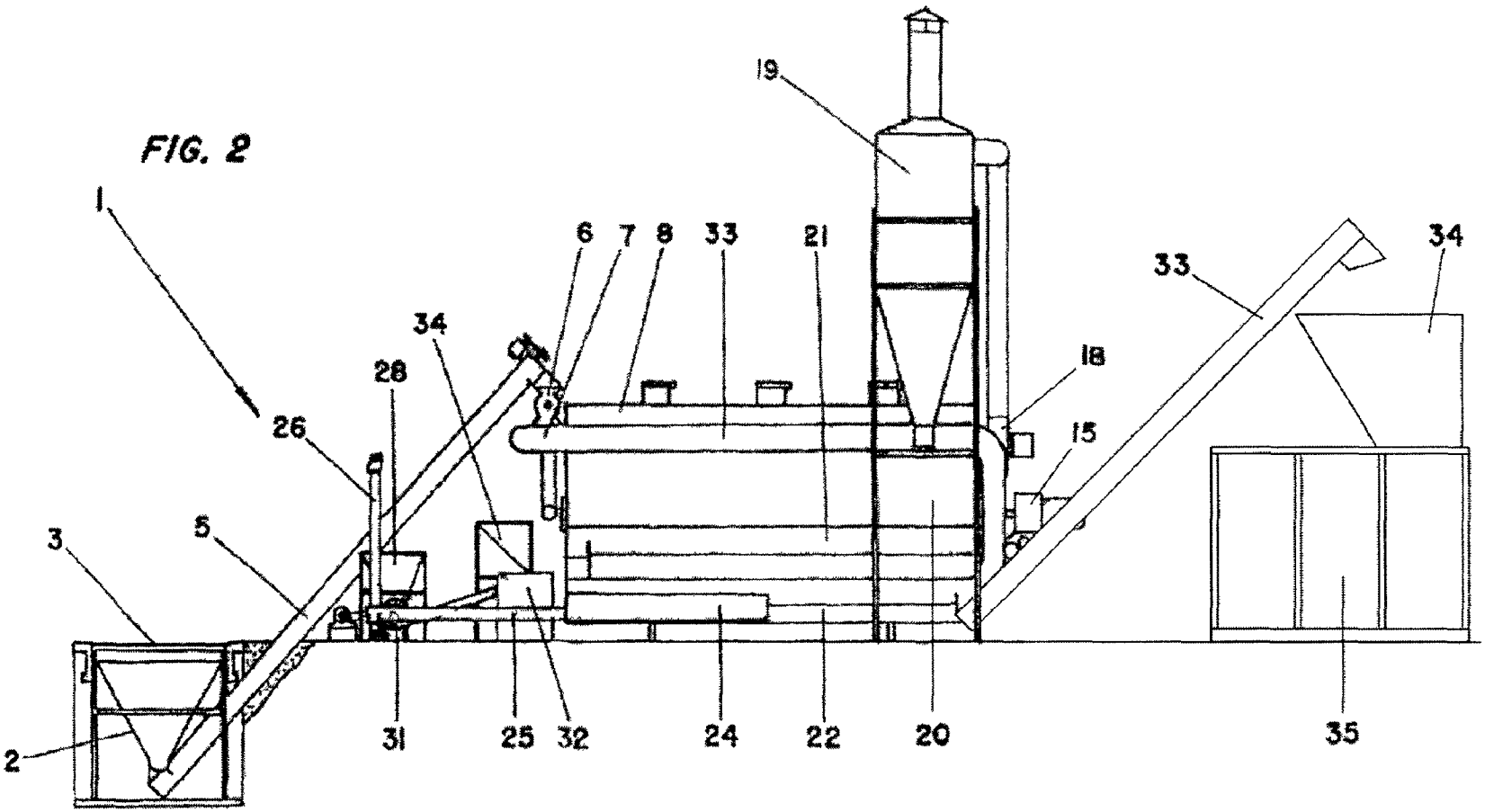
FIG. 2 shows a right-hand elevation of the compact drying unit, there being observed the hopper for receiving humid bagasse, the screw conveyor feeding the rotary valve, the drying tank, the dry powder hoppers, the burners (mixing chambers), the fierce heat-muffling hot air pipework, the dry bagasse suction blowers, the dry bagasse discharge hopper and the screw conveyor with open trough for the first cooling phase and the screw conveyor with open trough for the second cooling phase and separation of dry powder and trough receiving said powder and the screw conveyor discharging dry powder into an inclined screw conveyor for dropping into a distributor trough for the hoppers feeding the burners (mixing chambers)
Figure 4:
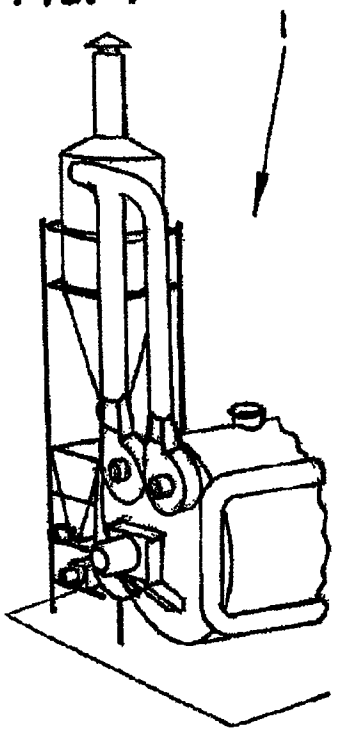
FIG. 4 shows an upper rear perspective view of said sugar bagasse drying unit, there being observed the geared motor which rotates the shaft carrying the tumbling blades and the centrifugal blowers which extract the dry cane bagasse and drop it into the separator filter.
Figure 3:
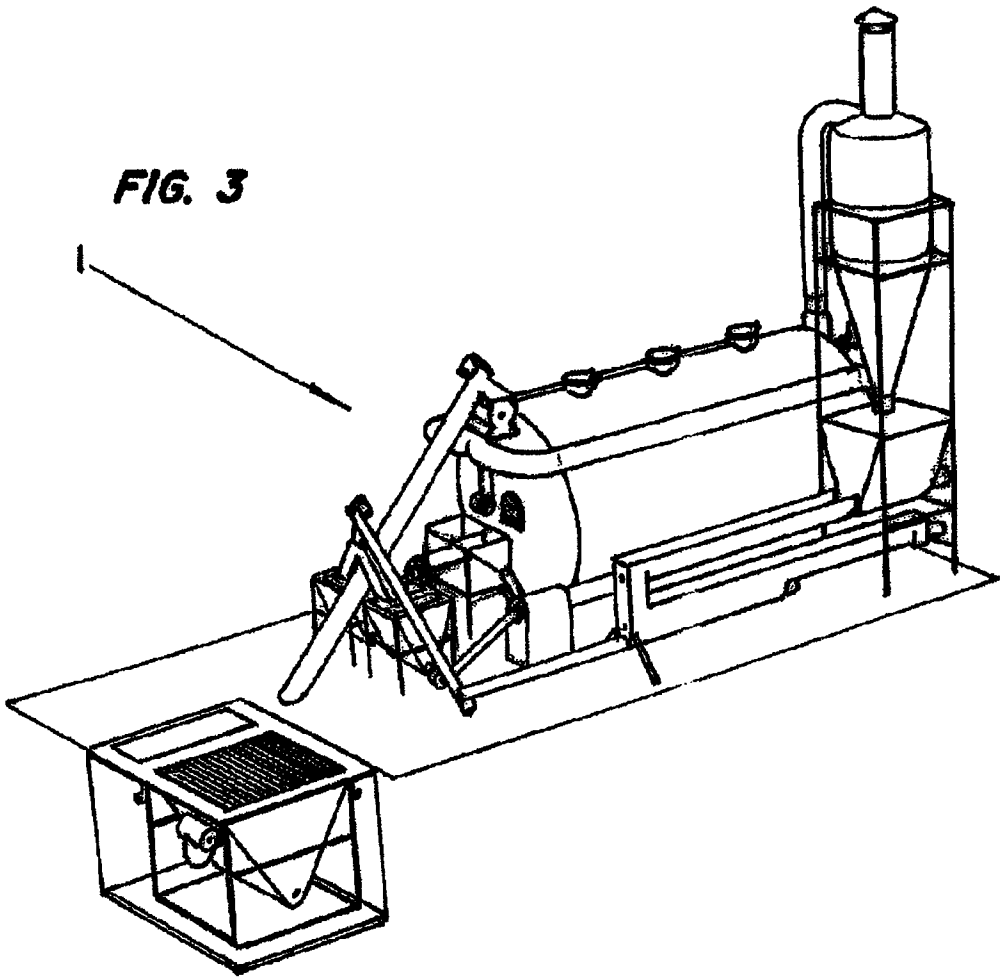
FIG. 3 shows an upper front perspective view of said sugar bagasse drying unit, there being observed the hopper for receiving humid bagasse, the screw conveyor feeding the rotary valve, the drying tank, the dry powder hoppers, one of the burners (mixing chambers), one of sets of fierce heat-muffling hot air pipework, the cyclone-type separator filter, the screw conveyors with open trough and the screw conveyor discharging dry powder into an inclined screw conveyor for dropping into a distributor trough for the hoppers feeding the burners (mixing chambers)
Figure 7:
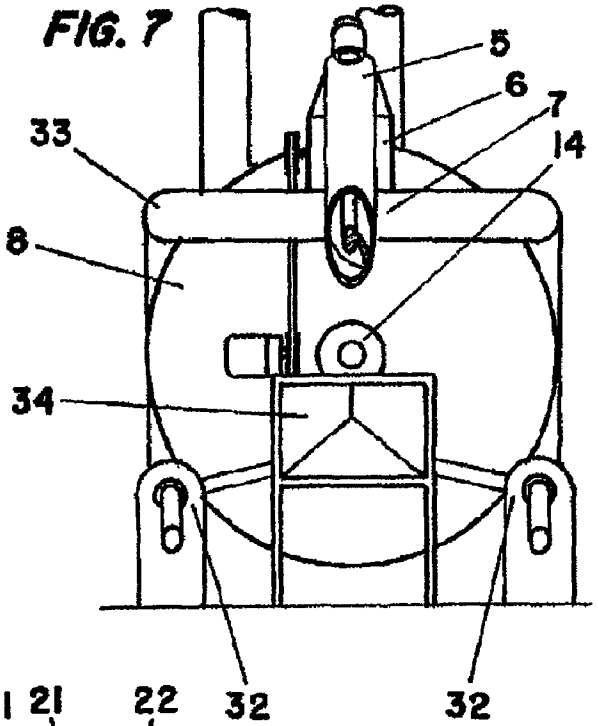
FIG. 7 shows a transverse cross-sectional view C-C' of the drying tank with the feed hopper for firing the igniters of the burners (mixing chambers), the hot air return pipework and the funnel with rotary valve dropping humid bagasse into the interior thereof.
Figure 5:
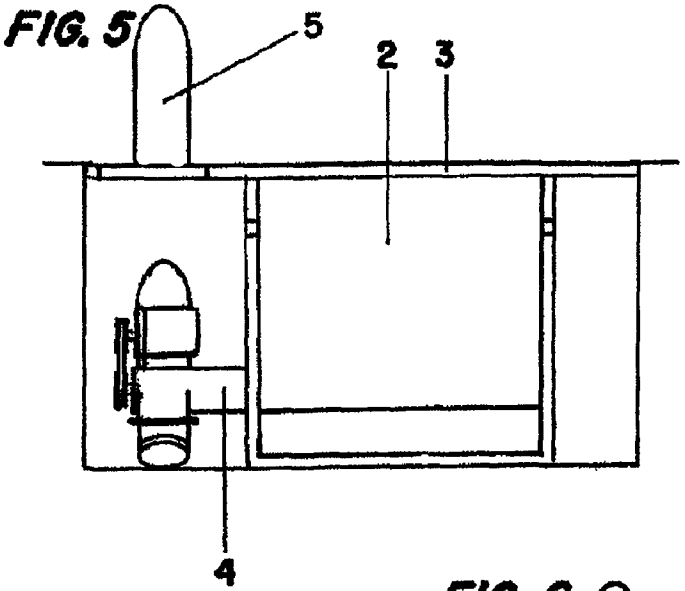
FIG. 5 shows a transverse cross-sectional view A-A' of the reception hopper with vibrating humid bagasse shredder screen, there being observed, in the bottom thereof, the dosing screw conveyor feeding the screw conveyor for discharge into the rotary valve.
Figure 6:
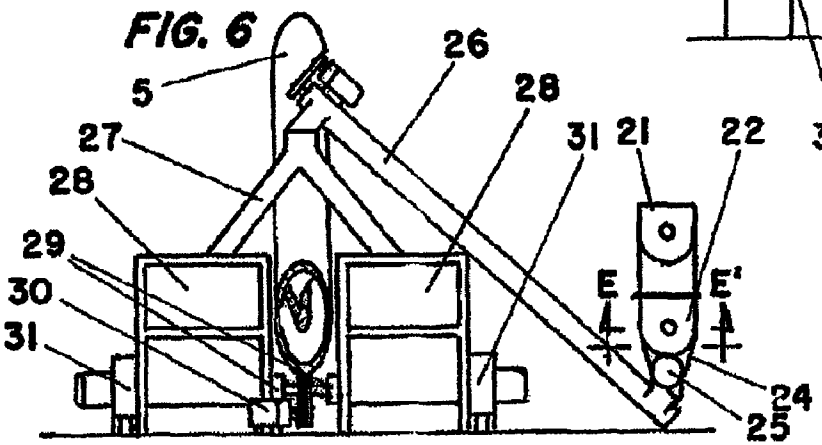
FIG. 6 shows a transverse cross-sectional view B-B' of the dry powder reception hoppers and feed to the burners (mixing chambers) and the blowers which drop the same onto the flames of the burners.
Figure 8:
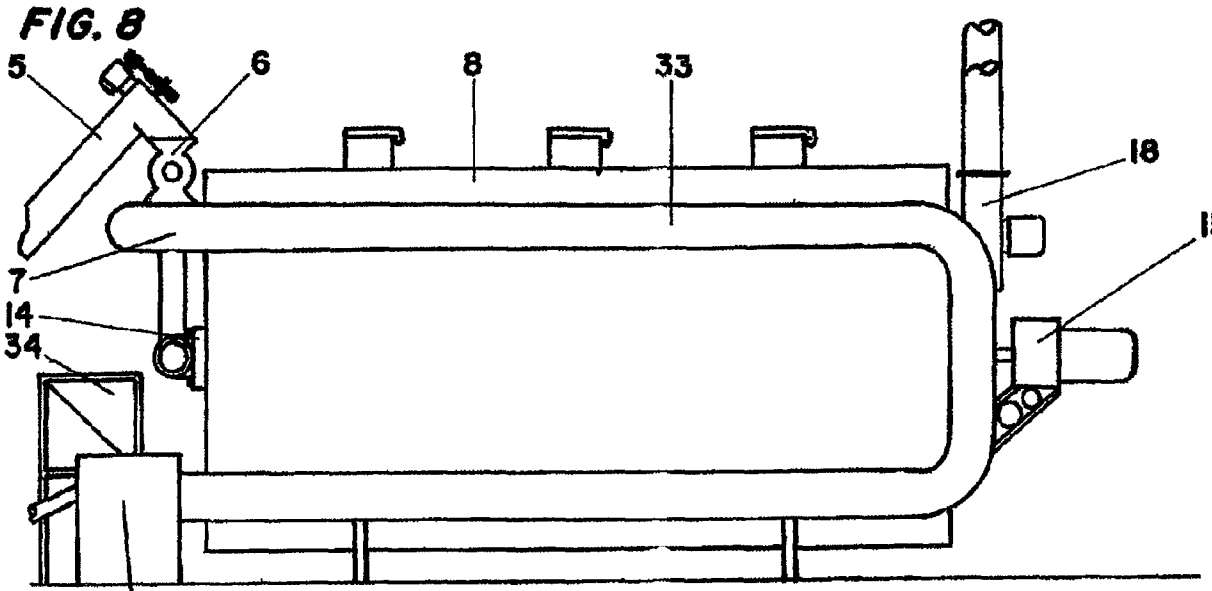
FIG. 8 shows a longitudinal cross-sectional view D-D' of the drying tank, there being observed the burners (mixing chambers) and the fierce heat-muffling pipework.
Figure 9:
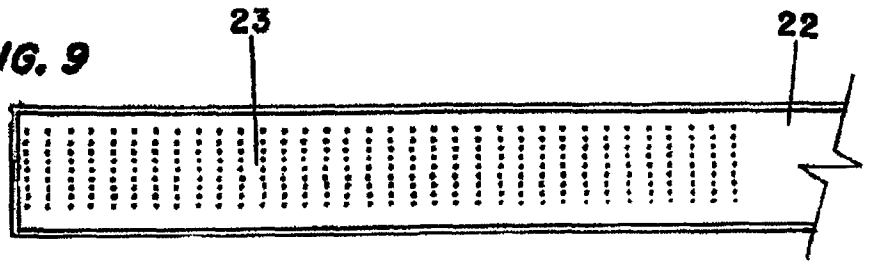
FIG. 9 shows a longitudinal cross-sectional view E-E' of detail of the multiply perforated bottom of the trough of the second dry bagasse cooling screw conveyor for the purpose of separating dry bagasse powder diverted to feed the feed hoppers of the burners (mixing chambers)
Figure 10:
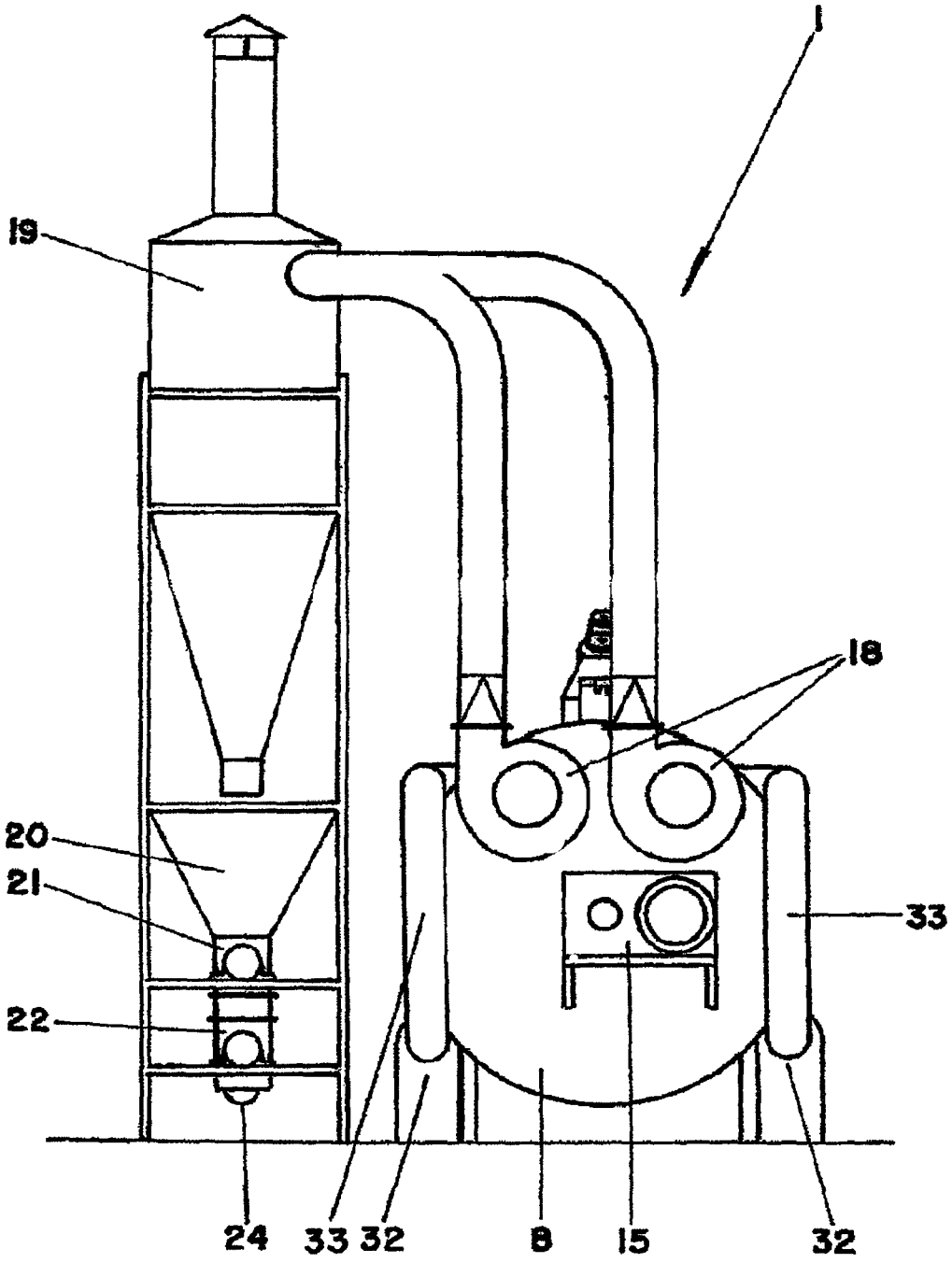
FIG. 10 shows a rear elevation of the said drying tank, there being observed the fierce heat-muffling pipework, the geared motor to rotate the shaft of the blades and the centrifugal blowers to extract the dry bagasse.
Figure 11:
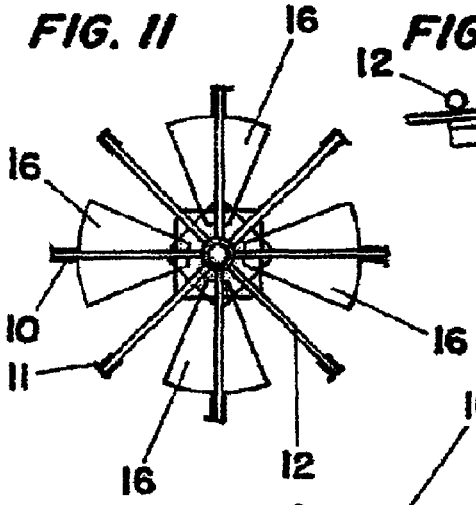
FIG. 11 shows a front elevation of the shaft carrying the assemblage of blades to lift still-humid and dry bagasse within the drying tank.
Figure 12:
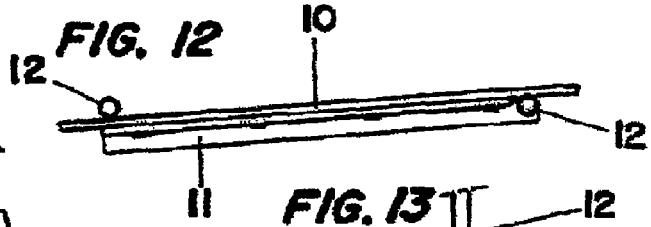
FIG. 12 shows an upper cross-sectional view of the parallel radial rods, one of the blades to lift humid and dry bagasse within the drying tank, there being observed the manner utilized for the fixation thereof in the form to some degree of a spiral and the metal section having the form of a claw to lift still-humid or dry bagasse.
Figure 13:
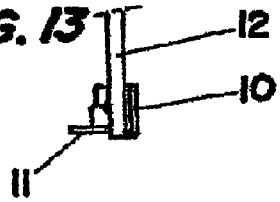
FIG. 13 shows a front elevation of the shape of one of the blades, there being observed the metal section having the form of a claw to lift still-humid or dry bagasse.
Figure 14:
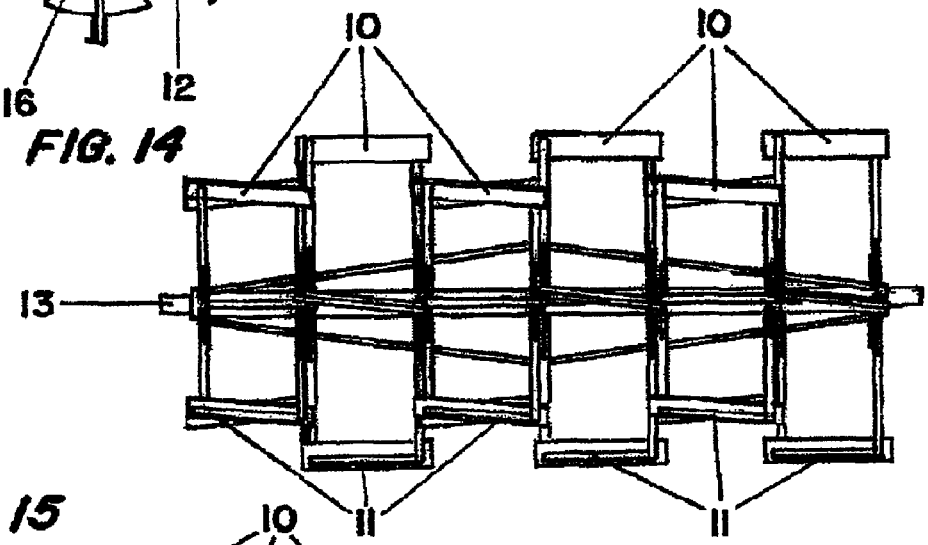
FIG. 14 shows a side innovation of the said shaft and assemblage of blades to lift still-humid or dry bagasse within the drying tank.
Figure 15:
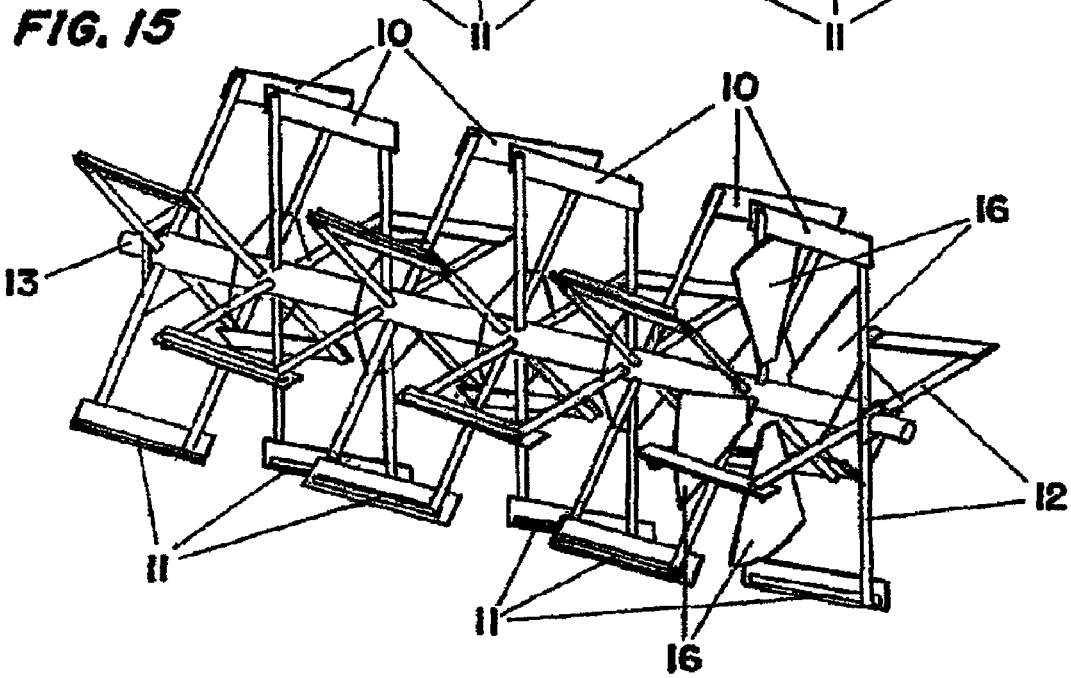
FIG. 15 shows an upper front perspective view of the said shaft and assemblage of blades to lift still-humid or dry bagasse within the drying tank.
Figure 16:
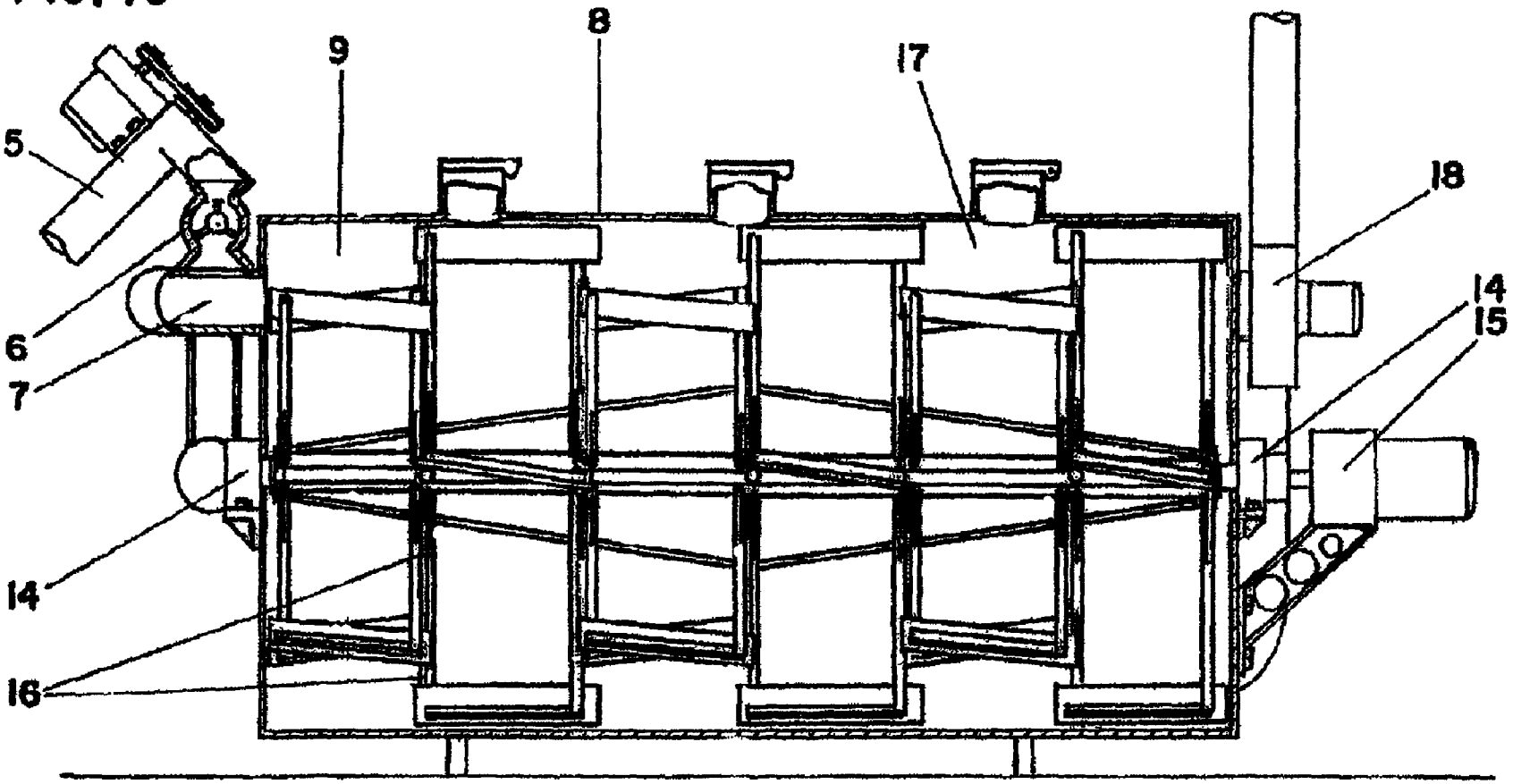
FIG. 16 shows a longitudinal cross-section view of the said shaft and assemblage of blades disposed within the drying tank, forming two drying chambers, the inlet chamber whereof having a substantially higher temperature, the outlet chamber having a substantially lower temperature.

The present specification of patent of invention relates to an IMPROVEMENT INTRODUCED INTO THE PROCESS OF DRYING CRUSHED CANE OR OTHER BAGASSES FOR SUBSEQUENT BRIQUETTING OR OTHER PRO- CESSES constituted by drying unit (1) comprising dosing hopper receiving humid bagasse (2) covered by slightly-inclined vibrating shredder screen (3) at ground level, said hopper (2) provided in the lower part thereof with a screw conveyor for humid bagasse (having a humidity of the order of 50 to 65%) (4) subsequently feeding screw conveyor inclined at 45.degree. (5) subsequently feeding rotary dosing valve (6) discharging humid bagasse within hot air funnel (7) and preventing the return of hot air, such hot air and humid cane bagasse being dropped into cylindrical drying tank (8) provided with a plurality of anti-explosion valves disposed in the top thereof, first contact of humid bagasse with the jet of hot air, having a temperature of the order of 500.degree. C., causing instantaneous volatilization of proteins (sugars), such humid bagasse being lifted and exposed to hot air in the front chamber (9) of drying tank (8) through the action of various assemblages of four opposed tumbling blades (10), having metal profiles (11) to lift still-humid bagasse affixed in an alternate manner at the extremities of parallel radial rods (12) projecting from longitudinal shaft (13) supported on bearings (14) and rotated through the action of geared motor (15), said front chamber (9) being formed through affixture of small plates (16), for the purposes of partial closing off, to one of supporting rods (12) between such first and second assemblages of blades, forming final drying chamber (17) having a substantially lower temperature, slightly-humid cane bagasse being lifted and driven to the bottom, almost-dry bagasse in suspension being sucked out by pair of centrifugal blowers (18), dropping it into cyclone-type separator filter (19) separating humid air from cane bagasse, having a humidity of the order of 10% and a temperature of the order of 40 to 50.degree. C., cane bagasse falling under gravity into hopper (20) subsequently feeding screw conveyor (21), the trough whereof being open, and in the return direction, that is to say in the direction of hopper (2), to partially cool such dry bagasse, at the end of this trajectory it being discharged into another screw conveyor (22), the trough whereof also being open however the movement whereof being in the inverse direction to that of screw conveyor (21), to complete the process of cooling dry bagasse, which finally falls into another inclined screw conveyor 33 to be dropped into a buffer silo 34 feeding in a continuous manner a briquetting machine 35, the trough of this second screw conveyor (22) having in its initial portion an extremity in the bottom thereof in the form of screen (23) to realize separation of dry bagasse powder from dry cane which falls into trough (24), being extracted and conveyed by screw conveyor (25) to a further inclined screw conveyor (26) dropping said dry cane bagasse powder into distributor trough (27) similarly dropping it into two feeder hoppers (28), said hoppers (28) having in the bottom part thereof screw conveyors having opposed screws (29) driven in a synchronized manner by single geared motor (30), dropping the powder into air ducts swept by blowers (31) such that said powder is dropped onto the flames of the burners (mixing chambers) (32) and the fierce heat generated by such combustion.

What is claimed is:

1. A process of drying crushed cane or other bagasses for subsequent briquetting comprising:

receiving humid bagasse in a dosing hopper (2) of a drying unit (1) that is covered by a slightly-inclined vibrating shredder screen (3) at ground level, said hopper (2) provided in the lower part thereof with a screw conveyor for the humid bagasse, the humid bagasse having a humidity on the order of 50 to 65% (4), subsequently, feeding the humid bagasse to the screw conveyor which is inclined at 45° (5), subsequently, feeding the humid bagasse to a rotary dosing valve (6);

discharging the humid bagasse within a hot air funnel (7) while preventing the return of hot air, dropping the hot air and humid cane bagasse into a cylindrical drying tank (8) provided with a plurality of anti-explosion valves disposed in a top thereof, contacting the humid bagasse with a jet of hot air, having a temperature of the order of 500° C., causing instantaneous volatilization of proteins (sugars), lifting the humid bagasse and exposing the humid bagasse to hot air in a front chamber (9) of the cylindrical drying tank (8) through the action of various assemblages of four opposed tumbling blades (10), the tumbling blades having metal profiles (11) configured to lift still-humid bagasse affixed in an alternate manner at the extremities of parallel radial rods (12) projecting from a longitudinal shaft (13) supported on bearings (14) and rotated through the action of a geared motor (15), said front chamber (9) being formed through affixture of small plates (16), for the purposes of partial closing off, to one of supporting rods (12) between such first and second assemblages of blades, forming a final drying chamber (17) having a substantially lower temperature, lifting and driving slightly-humid cane bagasse to the bottom of the final drying chamber, sucking almost-dry bagasse in suspension out by pair of centrifugal blowers (18), dropping it into a cyclone-type separator filter (19), separating humid air from cane bagasse, having a humidity of the order of 10 % and a temperature of the order of 40 to 50° C., allowing cane bagasse to fall under gravity into a hopper (20), subsequently feeding the cane bagasse to a screw conveyor (21) with an open trough, and discharging the cane bagasse in the return direction, in the direction of the hopper (2), to partially cool such dry bagasse, and into another screw conveyor (22), the trough whereof also being open, however the movement whereof being in the inverse direction to screw conveyor (21), to complete the process of cooling dry bagasse, which finally falls into another inclined screw conveyor to be dropped into a buffer silo feeding in a continuous manner a briquetting machine, the trough of the second screw conveyor (22) having in its initial portion an extremity in the bottom thereof in the form of screen (23) to realize separation of dry bagasse powder from dry cane which falls into trough (24), being extracted and conveyed by screw conveyor (25) to a further inclined screw conveyor (26), dropping said dry cane bagasse powder into distributor trough (27), similarly dropping it into two feeder hoppers (28), said feeder hoppers (28) having in the bottom part thereof screw conveyors having opposed screws (29) driven in a synchronized manner by a single geared motor (30), and dropping the powder into air ducts swept by blowers (31) such that said powder is dropped onto the flames of burners (32) and the fierce heat generated by such combustion.

* * * * *